US006104008A

United States Patent [19]

Larson

[11] Patent Number: 6,104,008

[45] Date of Patent: Aug. 15, 2000

[54] THERMAL LIMITER FOR STOVE HEATER

[76] Inventor: Eric K. Larson, 42 King Philip Rd., Narragansett, R.I. 02882

[21] Appl. No.: 09/019,854

[22] Filed: Feb. 6, 1998

Related U.S. Application Data

[63] Continuation-in-part of application No. 08/756,341, Nov. 26, 1996, Pat. No. 5,761,828.

[51] Int. Cl.[7] ..... H05B 3/68; H05B 1/02

[52] U.S. Cl. ..... 219/461.1; 219/495

[58] Field of Search ..... 219/445.1, 446.1, 219/448.11, 494, 495; 335/37, 146, 208, 217; 431/66, 67, 71

[56] References Cited

U.S. PATENT DOCUMENTS

| | | | |
|---|---|---|---|
| 2,339,089 | 1/1944 | Mantz | 192/12 R |
| 2,445,591 | 7/1948 | Sullivan | 219/495 |
| 2,673,263 | 3/1954 | Casey | 335/146 |
| 3,009,047 | 11/1961 | Simmons | 219/495 |
| 3,015,710 | 1/1962 | Kelly | 219/495 |
| 3,211,894 | 10/1965 | Alexander | 219/495 |
| 3,328,561 | 6/1967 | Sakamoto et al. | 219/495 |
| 3,933,419 | 1/1976 | Romanelli | 431/66 |

*Primary Examiner*—Sang Paik

[57] ABSTRACT

A temperature sensing switching device has a soft ferrite material coupled radiatively to a body and non-radiatively to a heat sink. The ferrite material is arranged so that its temperature is above its curie point when the body is above a desired limit temperature and below its curie temperature when the body is below this limit temperature. The change is the permeability of the ferrite material moves a magnet which controls the delivery of energy to the body. The switching device may be used to control a stove heater or a burner control system for controlling flow of combustible gas to a burner.

9 Claims, 7 Drawing Sheets

THERMAL LIMITER FOR STOVE HEATER

CROSS-REFERENCE TO RELATED APPLICATIONS

This application is a continuation-in-part of U.S. application Ser. No. 08/754,341 filed Nov. 11, 1996 now U.S. Pat. No. 5,761,828.

BRIEF SUMMARY OF THE INVENTION

This invention relates to devices for controlling operation of stove heaters, fabric drying machines and other heaters.

Gas fired clothes drying machines such as are used in household services typically are fired intermittently during the drying of a batch of clothes. This requires that the gas flow be restarted and ignited at the beginning of each burn period. The invention here described controls the gas flow and ignition in such a clothes dryer by coupling a soft ferrite material radiatively to an igniter element and non-radiatively to a heat sink. The temperature assumed by the ferrite material is above its curie point when the igniter element is hot enough to ignite the gas and below its curie temperature when the igniter is insufficient to ignite the gas. The change in the permeability of the ferrite material moves a magnet which controls the heating of the igniter element and the flow of gas.

A stove heater according to the invention is controlled by coupling a soft ferrite material radiatively to the stove heater and non-radiatively to a heat sink. The ferrite material is arranged so that its temperature is above its curie point when the stove heater is above a desired limit temperature and below its curie temperature when the burner is below this limit temperature. The change in the permeability of the ferrite material moves a magnet which controls the heating of the stove heater.

DETAILED DESCRIPTION

Figure 1:
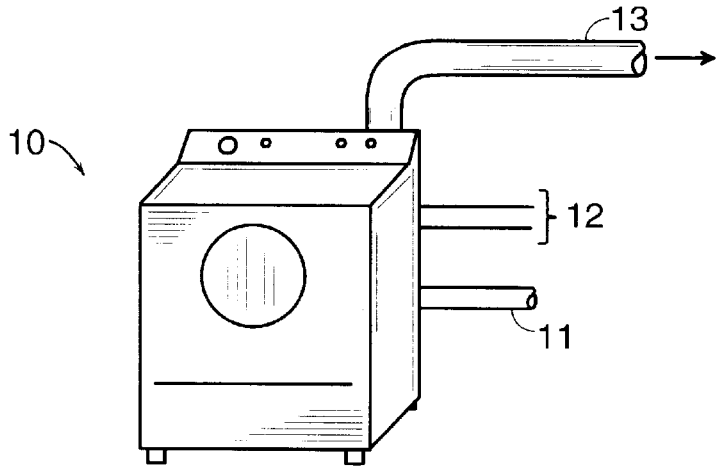
FIG. 1 shows a fabric drying machine according to the invention.

As shown in FIG. 1, fabric drying machine 10 according to the invention is supplied with combustible gas through pipe 11 and with electric power through conduit 12, and discharges water laden exhaust gases through vent 13.

Figure 2:
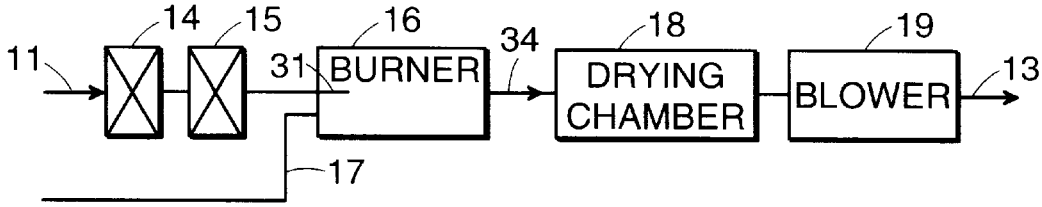
FIG. 2 shows schematically the paths of combustible gas and air through the drying machine of FIG. 1.

As shown particularly in FIG. 2, combustible gas passes from pipe 11 through valve 14 and valve 15 to gas nozzle 31 of burner 16. Ambient air is also admitted through air entry 17 to burner 16. From burner 16 a mix of air and combustion products pass through drying chamber 18 where water vapor is extracted from fabric being dried. The mixed gases then pass to blower 19 which pulls the gases through the system and delivers water laden exhaust to vent 13.

Figure 3:
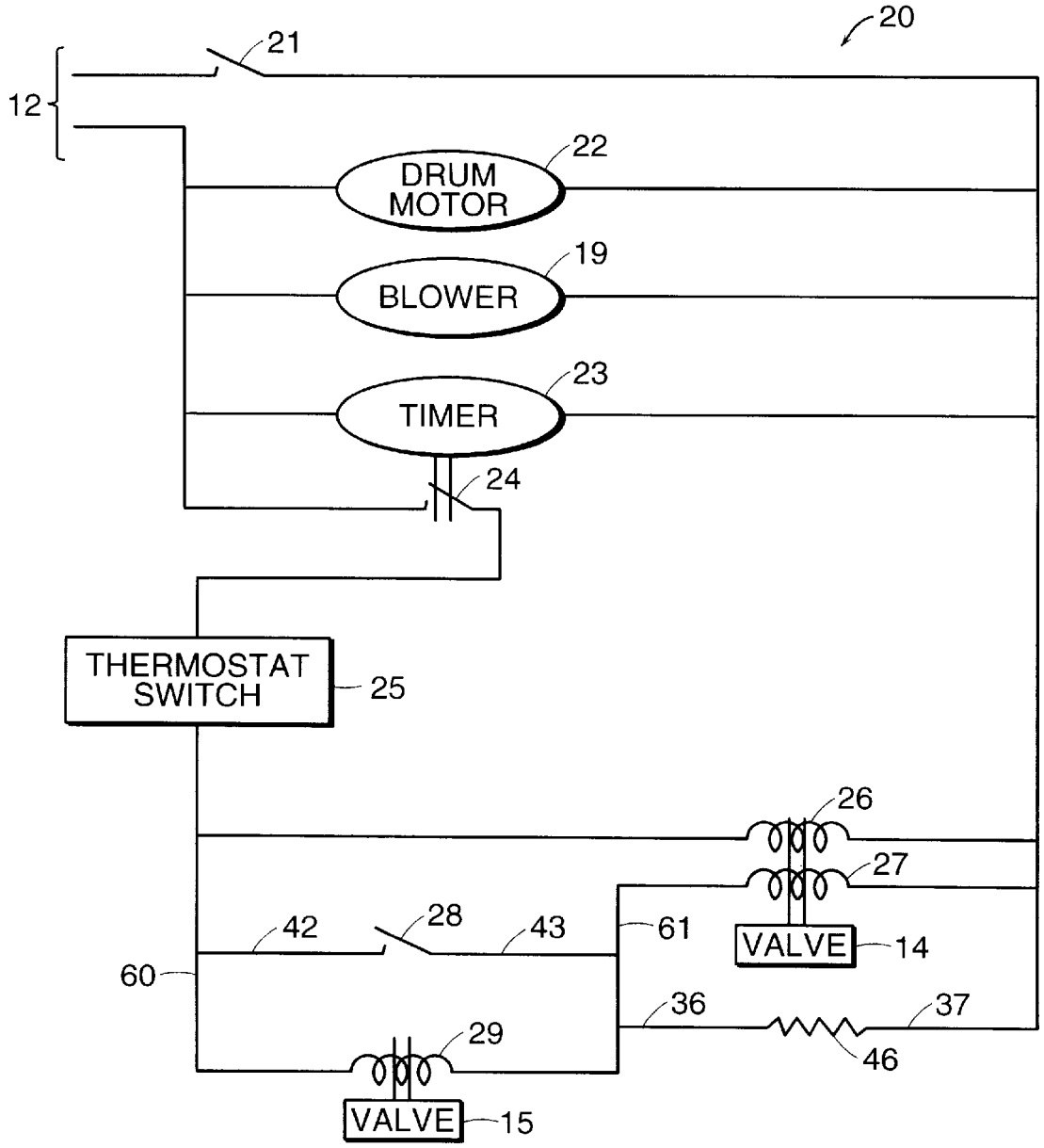
FIG. 3 shows schematically the principal electrical circuits of the drying machine of FIG. 1.

Electrical circuitry 20 controlling the operation of drying machine 10 is shown particularly in FIG. 3. It includes start switch 21 used by an operator to put the drying in operation, drum motor 22 which agitates the drying chamber 18, timer 23 coupled mechanically to timer switch 24, and thermostat switch 25 controlled by a thermostat in the drying chamber 18. Further circuitry controlling the gas combustion include solenoid 26 (with a reactance of about 1400 ohms) and solenoid 27 (with a reactance of about 600 ohms), both of which are linked to valve 14 so that energizing both solenoids is required to move the valve from a closed to an open condition, but energizing of solenoid 26 alone is sufficient to hold valve 14 in an open condition. Circuitry further includes control switch 28, solenoid 29 (with a reactance about 1200 ohms) linked to open valve 15 when energized and an electric path 46 through igniter element 30, all connected as shown.

Figure 4:
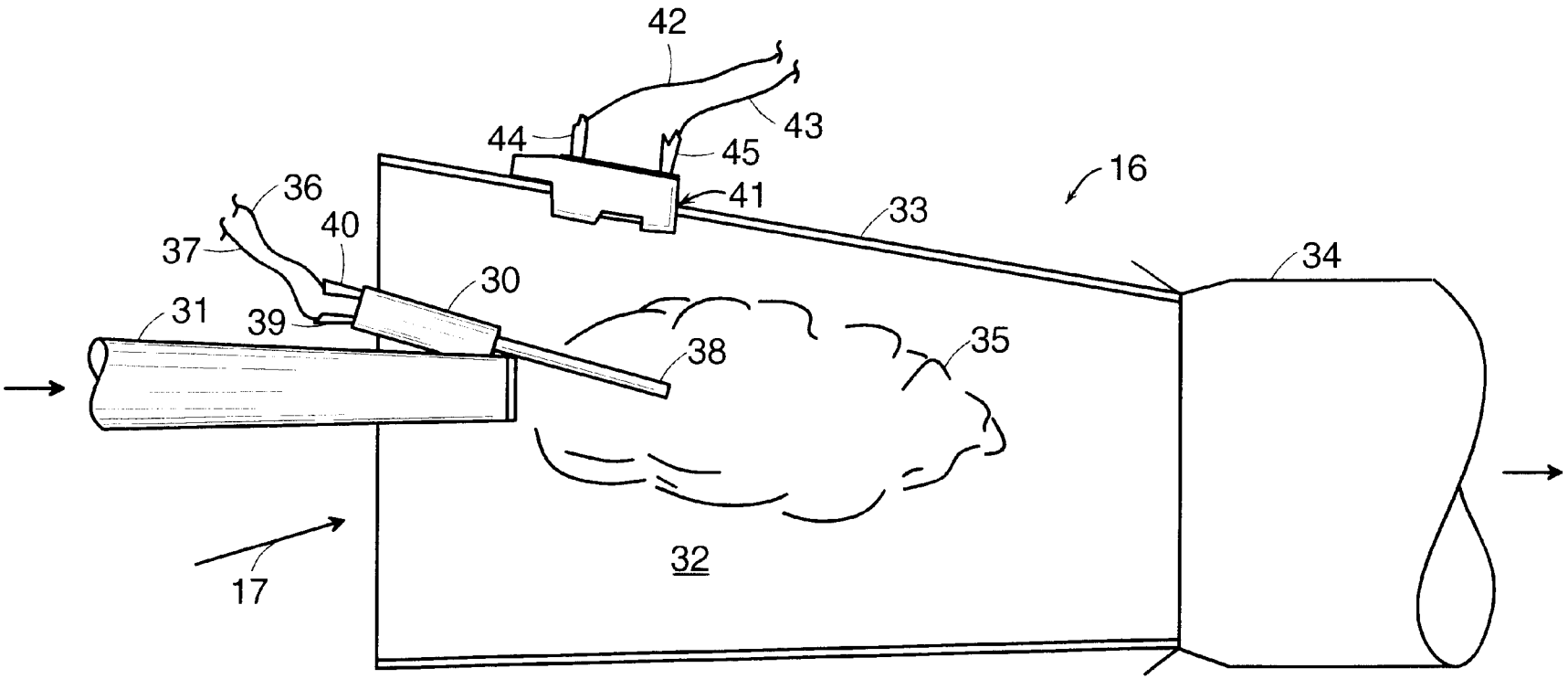
FIG. 4 shows in cross-section the gas burner assembly of the drying machine of FIG. 1.

Burner 16, as shown more particularly in FIG. 4, includes combustion chamber 32 within burner wall 33. Gas nozzle 31 ejects combustible gas into chamber 32 and air enters through entry 17. Duct 34 channels output gasses to drying chamber 18. When burner 16 is burning it holds a flame 35 which occupies a region within the burner.

Igniter element 30 provides a resistive electrical path 46 through silicon carbide between its terminals 39 and 40 which is connected by leads 36 and 37 to the circuitry shown in FIG. 3. It is commercially available. Igniter element 30 is affixed in burner 16 so that its heated portion 38 protrudes into the space occupied by flame 35.

Ignition condition sensor 41 is mounted in wall 33 of combustion chamber 32. Its terminals 44 and 45 are connected to the circuitry shown in FIG. 3 by leads 42 and 43.

Figure 5:
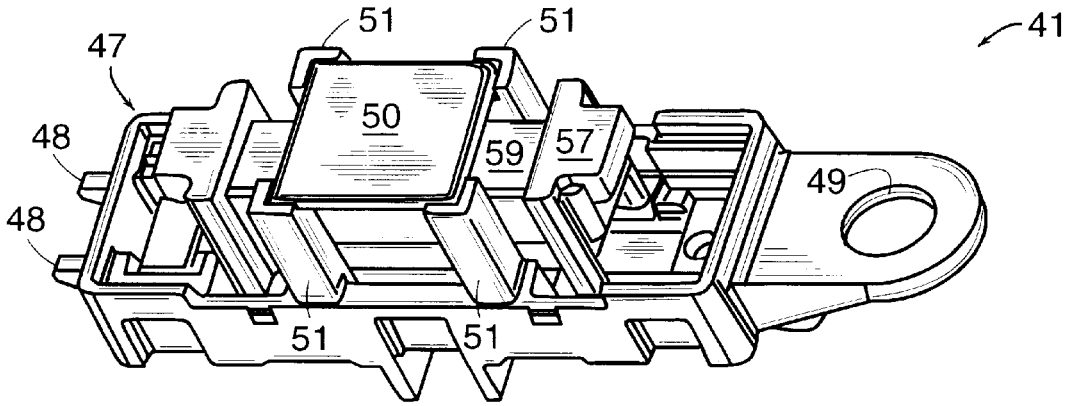
FIG. 5 shows a perspective view of an ignition condition sensor used in the fabric drying machine of FIG. 1 and shown in FIG. 4. The ignition condition sensor is shown with its cover removed.
Figure 6:
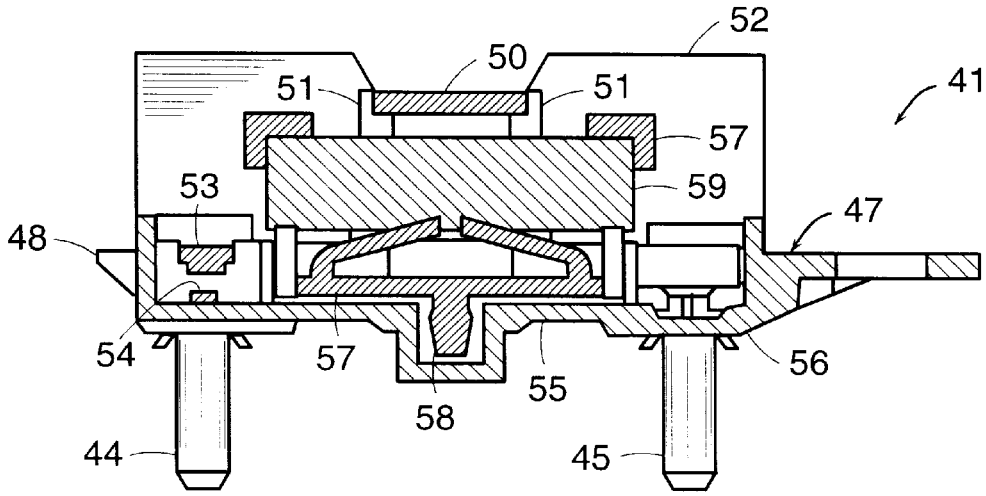
FIG. 6 shows in cross-section the ignition condition sensor shown in FIG. 4.

The construction of ignition condition sensor 41 is shown more particularly in FIGS. 5 and 6. Base 47 is made of molded polymeric material and is affixed to burner wall 33 by fingers 48 and screw hole 49. Base 47 supports pole piece 50 on four posts 51. Aluminum cover 52 has a window through which pole piece is exposed and is crimped to base 47 holding pole piece 50 in place against posts 51. Pole piece 50 has dimensions 1 cm×1 cm×0.1 cm and is made of a soft ferrite material formulated to have a curie temperature of 85 deg C. It is ferromagnetic when at a temperature below its curie temperature and not ferromagnetic when at a temperature above its curie temperature. A suitable pole piece is available from MMG North America, 126 Pennsylvania Av., Paterson, N.J. 07503 with reference to material number SCT-15BF-BF/85. Pole piece 50 is affixed through base 47 into wall 33 in a position so that pole piece 50 has a view of and is radiatively coupled to igniter element end 38 and is also exposed to and convectively coupled to air stream 17 which functions as a heat sink.

Terminal 44 is affixed to base 47 and electrically connected to contact point 53. Terminal 45 is affixed to base 47 and electrically connected to fixed end 56 of leaf spring 55, which is advantageously made of beryllium copper. Contact point 54 is affixed to the free end of leaf spring 55 opposite contact point 53. Leaf spring 55 is formed and affixed so that it urges contact point 54 away from contact point 53 and unless otherwise coerced leaves a gap between the contact points.

Magnet cradle 57 is attached to leaf spring 55 by knob 58 snapped through a hole in leaf spring 55 and is free to move up and down (as viewed in FIG. 6) with leaf spring 55. Permanent magnet 59 is captured in magnet cradle 57 and held thereby in position with a pole facing the inside face of pole piece 50. In the absence of a magnetic force between pole piece 50 and magnet 59 (as when pole piece is at a temperature above its curie temperature and note ferromagnetic) magnet cradle 57 and magnet 59 are pulled by spring 55 away from pole piece 50 leaving a gap between the magnet and the pole piece and a gap between contact points 53 and 54, thereby putting switch 28 in a non-conducting state. When pole piece 50 is at a temperature below its curie temperature and therefore ferromagnetic, magnetic force draws magnet 59 towards pole piece 50, overriding the urging of spring 55 and closing the gap between contact points 53 and 54, thereby putting switch 28 in a conductive state. Pole piece 50, permanent magnet 59, cradle 57, and spring 55 thus function as an actuation mechanism controlling the state of switch 28.

The operation of the clothes drying machine is as follows. Having loaded the drying chamber and selected a drying time, an operator initiates operation with the start switch 21. This sets the drum, blower, and timer going. Timer switch 24 remains closed for the duration of the drying period. Thermostat switch 25 closes when the dryer temperature is below a set temperature and open when the chamber is above a set temperature, producing alternating periods of heating and non-heating. Each time thermostat switch 25 is closed it initiates and ignition and burn cycle of the gas heater which continues until the drying chamber rises above a set temperature and opens switch 25.

Immediately prior to the instant when an ignition and burn cycle is initiated, solenoid coils 26, 27, and 29 will be de-energized, valves 14 and 15 will be closed, no flame will be present in burner 16, igniter 30 will be at temperature insufficient to effect ignition, pole piece 50 will be at a temperature below its curie temperature, magnet 59 will be pulled towards pole piece 50 and contact points 53 and 54 will be in contact, placing switch 28 in a conductive state. The conductive state of switch 28 is signaled by applying the potential of conductor 60 to conductor 61. Immediately after thermostat switch 25 closes, power is applied to solenoids 26 and 27 to open valve 14, and line voltage is applied across resistive path 46 in igniter 30. The resulting current through resistive path 46 heats igniter 30, which heats to a temperature above a minimum ignition temperature required to ignite the combustible gas. As the igniter heats it increasingly radiated energy to pole piece 50, which thereby is heated. When pole piece 50 heats to above its curie temperature, it ceases to be ferromagnetic and to attract magnet 59. Absent the attraction between magnet and pole piece, spring 57 pulls the manget away from the pole piece and moves contact points 53 and 54 apart to put switch 28 in a non-conductive state. The non-conductive state of switch 28 is signaled by ceasing to apply the potential of conductor 60 to conductor 61. With the potential of conductor 60 no longer applied to conductor 61 by switch 28, current passes through solenoid 29 and resistance 46 in parallel with solenoid 27 to energize solenoid 29 and open valve 15, and power to solenoid 27 and to resistance 46 is reduced. Valve 14 is held open by solenoid 26, and gas is admitted to burner nozzle 31 and is ignited by contact with hot igniter element 38. The flame and structure heated thereby now radiate strongly enough to keep pole piece 50 at a temperature above its curie temperature. At this point the solenoids, valves, gas flow, flame, and radiation continue without change until power to the control circuitry is shut off by the rising temperature in the drying chamber opening switch 25. When switch 25 is opened, all solenoids are depowered, both valves are shut, the flame goes out, radiation from the flame and igniter diminishes, and the pole piece cools below its curie temperature switching switch 28 to its conductive state. Conditions remain so until the switch 25 initiates a new ignition and burn cycle.

The invention can be adapted to other circumstances to discriminate whether a radiating body such as the igniter element is at a temperature above a predefined temperature such as the minimum ignition temperature. In any circumstances the radiative coupling of the pole piece to the radiating body, the non-radiative coupling of the pole piece to some heat sink such as the gas stream in the detailed example, and the curie temperature of the pole piece are to be adjusted so that the temperature assumed by the pole piece rises above its curie temperature when the temperature of the radiating body rises above the predefined temperature. Methods for making calculations to achieve this adjustment in specific circumstances are well known to those skilled in the art of thermal engineering.

Figure 7:
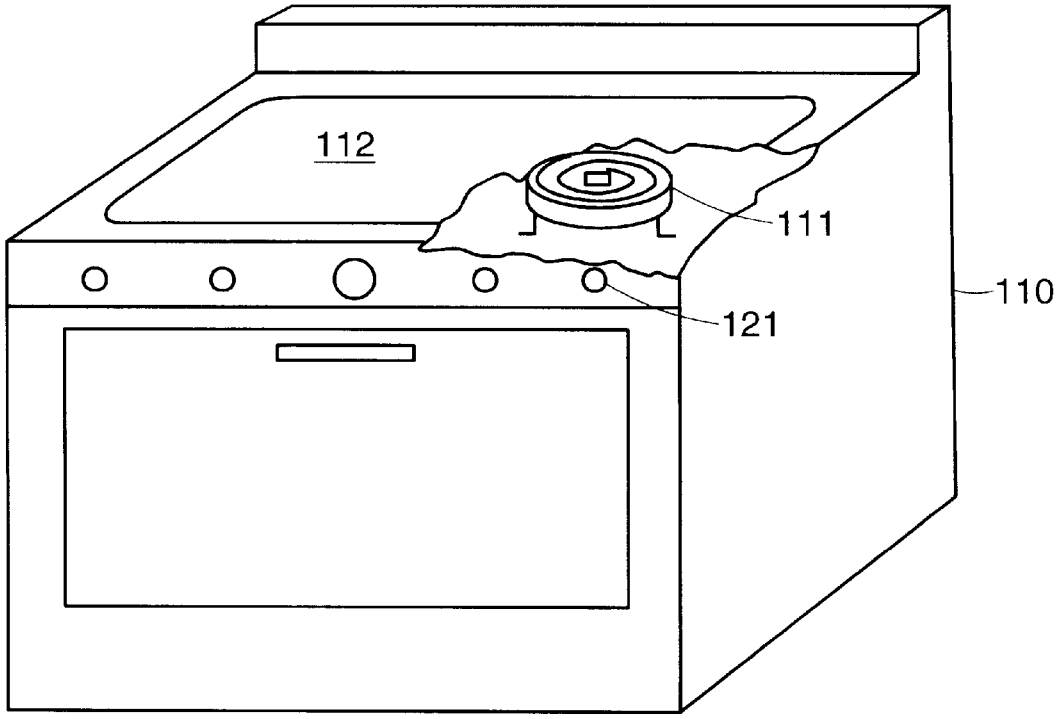
FIG. 7 shows a stove with a portion of its top broken away to show a heater and temperature sensing switching device according to the invention.
Figure 8:
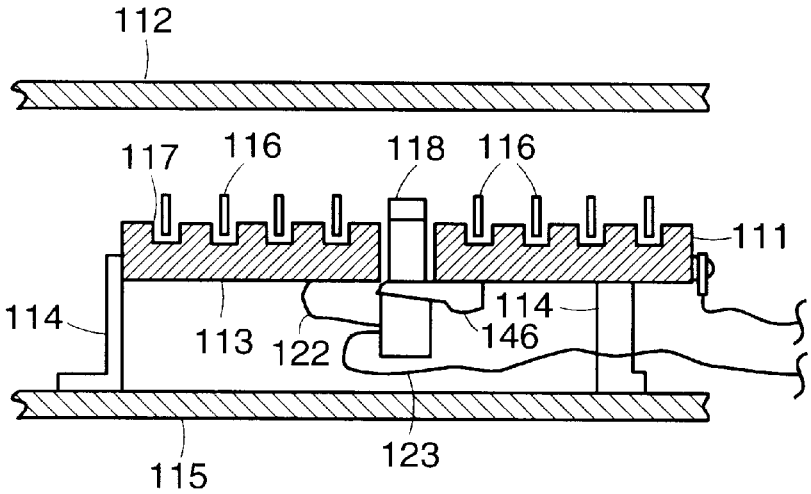
FIG. 8 shows a cross-sectional of the stove heater of FIG. 7 with temperature switching device.

As shown in FIG. 7, stove 110 has heater 111 supported beneath stove top 112 so as to heat a portion of the stove top. As shown particularly in FIG. 8, heater 111 includes heater support 113 supported through legs 114 on stove structure 115 and supporting resistance heating element 116 lodged in grooves 117 and temperature sensing switching device 118.

Figure 9:
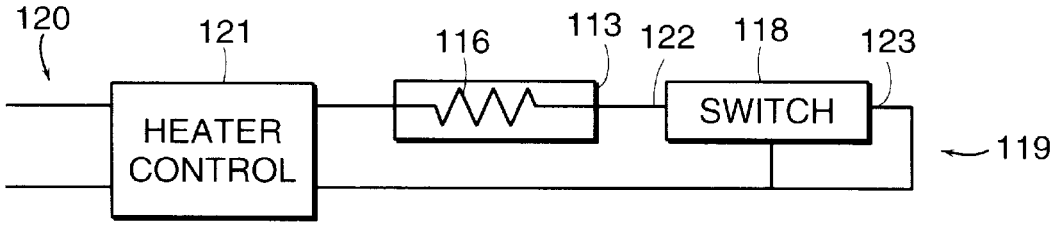
FIG. 9 shows a schematic diagram of the electrical connections of the stove heater and temperature sensing switching device of FIG. 7.

As shown in FIG. 9, temperature switching device 118 is connected through its terminals 122 and 123 in a series circuit 119 with resistance heating element 116 to power source 120 through stove heater control 121.

Figure 10:
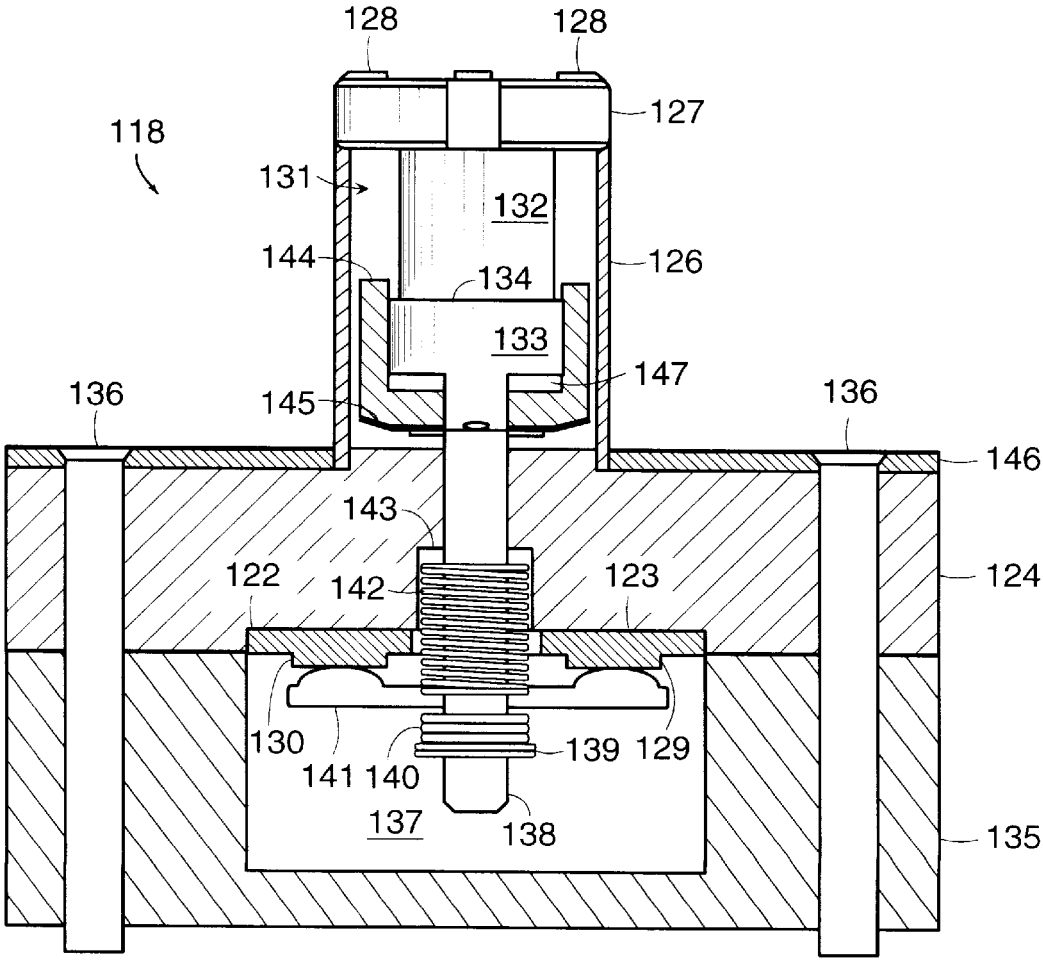
FIG. 10 shows a cross-sectional view of the temperature switching device of FIG. 8.

Temperature switching device 118, whose construction is shown particularly in FIG. 10, has a base 124 which supports terminals 122, 123 (These protrude toward the view as seen in FIG. 10.) which terminate in the interior in contact points 129, 130, turret 126 and cover 135, which is affixed to base 124 by rivets 136 to provide an enclosed space 137. Pole piece 127 has the form a cylindrical wafer with diameter 0.4 in. by 0.12 in. thick and is affixed to the end of turret 126 by tines 128. Switch actuation mechanism 131 is positioned within turret 126 and includes cylindrically shaped permanent magnet 132 with diameter 0.25 in. and actuator 133, fitting loosely within centering cup 144. Centering cup 144 is supported on seat 145 which is affixed to turret 126. Actuator 133 has a broad face 134 making contact with magnet 132 and a shaft 138 extending into space 137. Stop nut 139 is affixed to shaft 138 capturing take-up spring 140 and contactor 141. Bias spring 142 is captured between contactor 141 and shoulder 143 in base 125. When magnet 132 is touching pole piece 127 (as shown in FIG. 10) there is a gap 147 of 0.03 in.between the inner bottom of centering cup 144 and the upper portion of actuator 133.

Temperature switching device 118 is affixed to heater support 113 by bracket 146 in such a position that pole piece 127 is raised above the surface of register heating element 116 so as to be radiatively coupled to element 116 and to receive heat radiation therefrom.

The permanent magnet is made of Alnico-8; the actuator is made of a soft ferromagnetic material.

Figure 11:
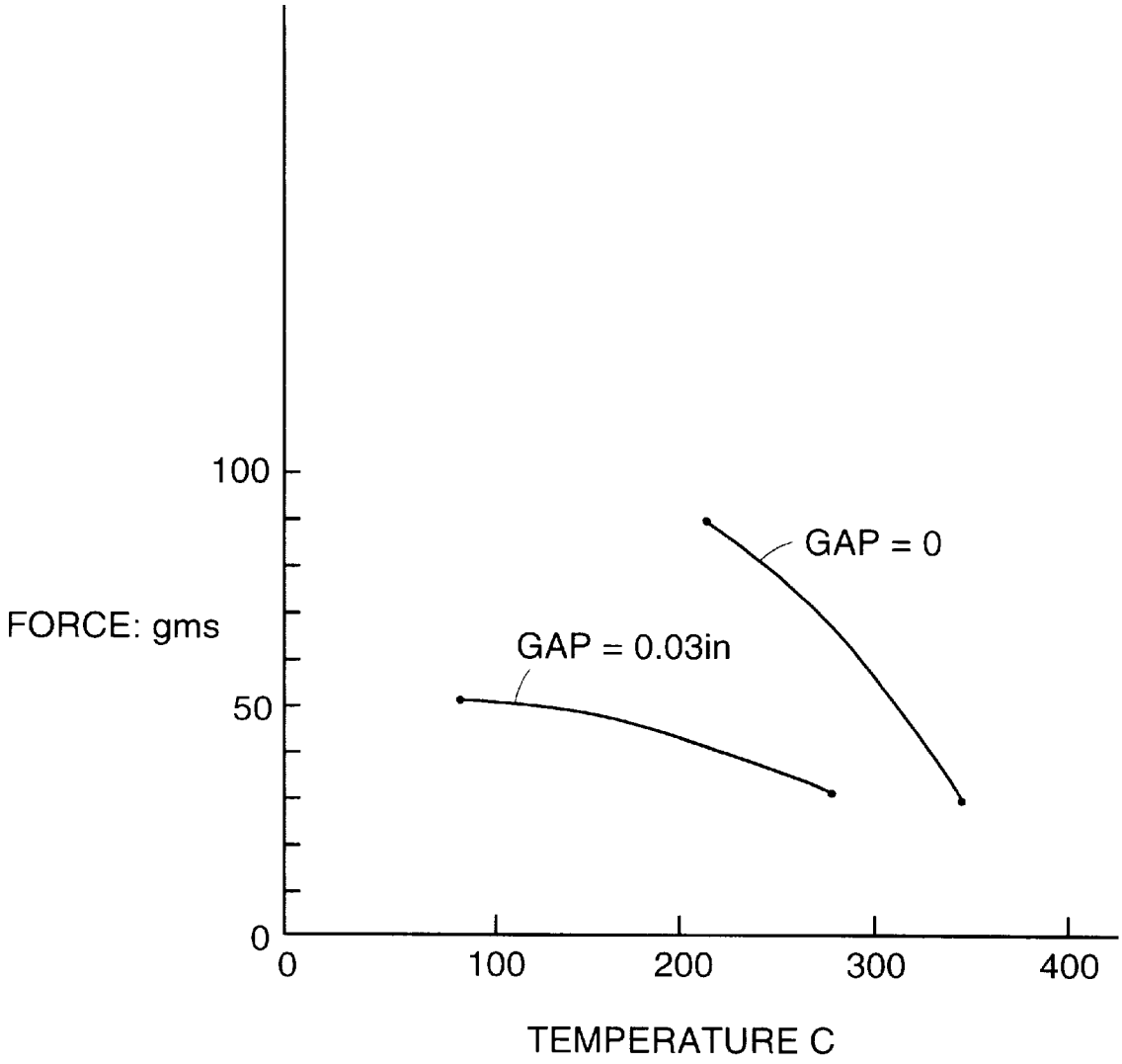
FIG. 11 shows for different temperatures and air gaps the magnetic force between the magnet and the pole piece of the temperature sensing device of FIG. 7.

The pole piece is made of a material that is ferromagnetic at room temperature but at temperatures above a Curie temperature is non-ferromagnetic. A suitable pole piece is available from MMG North America, 126 Pennsylvania Av., Paterson, N.J. 07503 with reference to material number ACT-3KCA.500. The magnetic force between the magnet and the pole piece at different temperatures and for the gap between them of 0 and 0.03 in. is shown in FIG. 11.

Parts other than the magnet, actuator, and pole piece are made of non-magnetic material.

The operation of the stove heater is as follows. At a time when the stove heater is not in use, the stove heater control is not supplying power, and the resistance heating element of the heater is cool. The pole piece of the temperature switching device will be below its Curie temperature and so ferromagnetic. Accordingly, the magnetic force between the permanent magnet and the pole piece will overpower the force of the spring and draw the magnet to a position with the magnet in contact with the pole piece and the contactor pulled against the terminals. When an operator manipulates the heater control to start the heater electric power will be applied to the heating element through the temperature switching device. The temperature of the heating element will rise and as it does so the heating element will radiate increasingly to both the stove top and the pole piece, raising their temperatures. As the pole piece of the temperature switching device gets hotter, it will increasingly lose heat by conduction through the magnet and the turret wall to the lower portions of the switching device which function as a heat sink. In some circumstances, depending on the level of power commanded by the operator of the heater control and what is being heated on the stove top, temperature of the heater element will stabilize with the temperature of the pole piece less than its Curie temperature and the delivering heat at a constant rate to the stove top. In other circumstances, for example, when the heater control is set high and there is no object on the stove top, the temperature of the heater element will rise and radiate increasing energy to the pole piece to raise its temperature above its Curie temperature. When this happens the attractive force between the pole piece and the magnet will fall below the force of the bias spring and the contactor will be pushed by the spring to a position out of contact with the terminals and so opening the circuit through the heater element. With the heating element unpowered it will cool and radiate less to the pole piece which will permit it to cool. After an interval the pole piece will cool below its Curie temperature and will become ferromagnetic. When it does so it will attract the magnet with sufficient force to overcome the bias spring and pull the contactor into position connecting the terminals and apply power to the resister element.

What is claimed is:

1. A stove heater for heating a portion of a stove top comprising a resistive heating element, a heater support supporting said resistance heating element, and a temperature sensing switching device, said resistance heating element and said switching device being connected in a series circuit to a source of electrical power, said switching device comprising a base, two terminals supported on said base connecting the switching device into said series circuit, a contactor movable to a first position in which it connects said terminals and to a second position in which it disconnects said terminals, an actuation mechanism controlling the position of said contactor comprising a spring, a pole piece and a permanent magnet, said spring being positioned and arranged so as to provide a spring force urging said contactor toward said second position, said pole piece being supported on said base and positioned and arranged so as to have radiative coupling to said resistance heating element and receive thermal radiation therefrom, and to be thermally coupled to a heat sink, the radiative coupling to the heating element and the coupling to the heat sink being such that the pole piece assumes a temperature substantially below that of the heating element, said permanent magnet being movable towards or away from said pole piece, and being arranged so that said pole piece is within its magnetic field and positioned and arranged so that when it moves toward said pole piece it urges said contactor toward said first position, said pole piece being made of material which has a curie temperature and is ferromagnetic when at a temperature below said curie temperature and not ferromagnetic when at a temperature above said curie temperature, said pole piece when below said curie temperature attracting said magnet with a force overcoming said spring force and moving said contactor to said first position, and when above said curie temperature attracting said magnet with a force less than said spring force, the curie temperature of said pole piece material and the radiative coupling of said pole piece to said resistance heating element being such that the temperature of said heating element is limited.

2. A stove heater as claimed in claim 1, wherein said pole piece is mad of a nickel-zinc ferrite material in the general shape of a cylinder with diameter 0.4 in. and thickness 0.1 in.

3. A stove heater as claimed in claim 2, arranged and constructed so that when said controller is in said first position said magnet is spaced from said pole piece by 0.03 in.

4. A stove heater as claimed in claim 1, in which said pole piece is coupled non-radiatively to a heat sink.

5. A sensor discriminating whether a radiating body is a temperature above a predefined temperature, said sensor comprising an electrical switch which in a first state emits a first electric signal and in a second state emits a second electric signal, a switch actuation mechanism controlling said electrical switch comprising a permanent magnet and a pole piece and a spring, said magnet and pole piece being supported so as to be movable towards or away from each other and said spring being connected and arranged so as to provide a spring force urging said magnet and said pole piece apart, said magnet and said pole piece being mechanically connected to said switch in such manner that when said magnet and said pole piece are moved towards each other said switch is put in said first state and when moved away from each other said switch is put in said second state, said pole piece being made of material which has a curie temperature substantially below said predefined temperature and is ferromagnetic when at a temperature below said curie temperature and not ferromagnetic when at a temperature above said curie temperature, said pole piece being positioned so as to be radiatively coupled to said body and receive thermal radiation therefrom and to be thermally coupled non-radiatively to a heat sink so as to pass heat thereto, said magnet being positioned so that said pole piece is within its magnetic field, said pole piece when below said curie temperature being attracted to said magnet with a force overcoming said spring force and moving said pole piece and said magnet together and when above said curie temperature being attracted to said magnet with a force less than said spring force so that said pole piece and said magnet move apart, radiative coupling between said pole piece and said body, non-radiative coupling of said pole piece to said heat sink, and curie temperature of said pole piece material being such that when said body is at a temperature above said predefined temperature said pole piece assumes a temperature above said curie temperature, and when said body is at a temperature below said predefined temperature said pole piece assumes a temperature below said curie temperature.

6. A sensor as claimed in claim 5, wherein said radiating body is a stove heater, and said electrical switch controls heating of said stove heater.

7. A burner control system for controlling flow of combustible gas to be burned comprising a gas burner which when supplied with combustible gas and ignited holds a flame, an igniter element connected to electrical circuitry supplying a heating current and positioned to be heated by said flame and when hot to ignite combustible gas issuing into said gas burner, an electrical switch which in a first state delivers electrical power to heat said igniter element and effects blocking of gas flow to said burner and in a second state effects flow of gas to said burner and reduces electrical power to said igniter element, a switch actuation mechanism controlling said electrical switch comprising a permanent magnet and a pole piece and a spring, said magnet and pole piece being supported so as to be movable towards or away from each other and said spring being connected and arranged so as to provide a spring force urging said magnet and said pole piece apart, said magnet and said pole piece being mechanically connected to said switch in such manner that when said magnet and said pole piece are moved towards each other said switch is put in said first state and when moved away from each other said switch is put in said second state, said pole piece being made of material which has a curie temperature and is ferromagnetic when at a temperature below said curie temperature and not ferromagnetic when at a temperature above said curie temperature, said pole piece being positioned away from said igniter element and so as to be radiatively coupled to said igniter element and receive thermal radiation therefrom and to be thermally coupled non-radiatively to a heat sink so as to pass heat thereto, said magnet being positioned so that said pole piece is within its magnetic field, said pole piece when at a temperature below said curie temperature being attracted to said magnet with a force overcoming said spring force and moving said pole piece and said magnet together and when above said curie temperature being attracted to said magnet with a force less than said spring force so that said pole piece and said magnet move apart, radiative coupling between said pole piece and said igniter element, non-radiative coupling of said pole piece to said heat sink, and curie temperature of said pole piece material being such that when said igniter element is at a temperature to ignite said combustible gas said pole piece assumes a temperature above said curie temperature and substantially below the temperatures of said igniter, and when said igniter element is at a temperature insufficient to ignite said combustible gas said pole piece assumes a temperature below said curie temperature.

8. A sensor as claimed in claim 5 wherein said pole piece has a curie temperature less than 100 deg C.

9. A burner control system for controlling flow of combustible gas to be burned comprising a gas burner which when supplied with combustible gas and ignited holds a flame, an igniter element connected to electrical circuitry supplying a heating current and positioned to be heated by said flame and when hot to ignite combustible gas issuing into said gas burner, an electrical switch which in a first state delivers electrical power to heat said igniter element and effects blocking of gas flow to said burner and in a second state effects flow of gas to said burner reduces electrical power to said igniter element, a switch actuation mechanism controlling said electrical switch comprising a permanent magnet and a pole piece and a spring, said magnet and pole piece being supported so as to be movable towards or away from each other and said spring being connected and arranged so as to provide a spring force urging said magnet and said pole piece apart, said magnet and said pole piece being mechanically connected to said switch in such manner that when said magnet and said pole piece are moved towards each other said switch is put in said first state and when moved away from each other said switch is put in said second state, said pole piece being made of material which has a curie temperature and is ferromagnetic when at a temperature below said curie temperature and not ferromagnetic when at a temperature above said curie temperature, said pole piece being positioned away from said igniter element and so as to be radiatively coupled to said igniter element and receive thermal radiation therefrom and to be thermally coupled non-radiatively to a heat sink so as to pass heat thereto, said magnet being positioned so that said pole piece is within its magnetic field, said pole piece when at a temperature below said curie temperature being attracted to said magnet with a force overcoming said spring force and moving said pole piece and said magnet together and when above said curie temperature being attracted to said magnet with a force less than said spring force so that said pole piece and said magnet move apart, radiative coupling between said pole piece and said igniter element, non-radiative coupling of said pole piece to said heat sink, and curie temperature of said pole piece material being such that when said igniter element is a temperature to ignite said combustible gas said pole piece assumes a temperature above said curie temperature and below the temperature of said igniter, and when said igniter element is at a temperature insufficient to ignite said combustible gas said pole piece assumes a temperature below said curie temperature, wherein said pole piece has a curie temperature less than 100 deg C.

* * * * *

UNITED STATES PATENT AND TRADEMARK OFFICE

CERTIFICATE OF CORRECTION

PATENT NO. : 6104008
DATED : Aug. 15, 2000
INVENTOR(S) : Eric K. Larsen

It is certified that error appears in the above-Indentified patent and that said Letters Patent is hereby corrected as shown below:

At col. 5, line 53:
"resistive" should be --resistance--

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*